US005753850A

United States Patent [19]

Chawla et al.

[11] Patent Number: 5,753,850

[45] Date of Patent: May 19, 1998

[54] SHAPED CHARGE FOR CREATING LARGE PERFORATIONS

[75] Inventors: Manmohan S. Chawla, Adelphi, Md.; Joseph D. Simich; Steven W. Henderson, both of Katy, Tex.; Robert K. Bethel, Houston, Tex.

[73] Assignee: Western Atlas International, Inc., Houston, Tex.

[21] Appl. No.: 675,268

[22] Filed: Jul. 1, 1996

[51] Int. Cl.[6] ..... F42B 1/02

[52] U.S. Cl. ..... 102/307; 102/476

[58] Field of Search ..... 102/307, 476

[56] References Cited

U.S. PATENT DOCUMENTS

| | | | |
|---|---|---|---|
| 2,579,323 | 12/1951 | Kessenich | 102/307 |
| 2,988,994 | 6/1961 | Fleischer et al. | 102/307 |
| 4,080,898 | 3/1978 | Gieske et al. | 102/307 |
| 4,574,702 | 3/1986 | Brandt | 102/476 |
| 4,841,864 | 6/1989 | Grace | 102/307 |
| 4,858,531 | 8/1989 | Lindstadt et al. | 102/307 |
| 5,155,297 | 10/1992 | Lindstadt et al. | 102/476 |
| 5,559,304 | 9/1996 | Schweiger et al. | 102/476 X |

FOREIGN PATENT DOCUMENTS

| | | | |
|---|---|---|---|
| 2555729 | 5/1985 | France | 102/476 |
| 3436934 | 1/1986 | Germany | 102/476 |

*Primary Examiner*—Peter A. Nelson
*Attorney, Agent, or Firm*—Alan J. Atkinson

[57] ABSTRACT

An apparatus for generating a large perforation in a target such as a wellbore casing. A liner is positioned within a charge case lowered into a well. An explosive material is initiated to collapse the liner to form a material penetrating jet. A spoiler is positioned proximate to the liner to defocus the liner collapse. The spoiler forms a hollow center in the material penetrating jet and concentrates the energy of the jet into a large annular ring for penetrating the target. The spoiler can comprise a passive spoiler which blocks the full collapse of the liner, or can comprise an active spoiler incorporating a high explosive or an elastic material for counteracting the liner collapse. The spoilers can be spherical, cylindrical, tapered, or another shape to modify the configuration and performance of the material penetrating jet, and a spacer can retain a spoiler in a selected orientation relative to the liner.

12 Claims, 2 Drawing Sheets

SHAPED CHARGE FOR CREATING LARGE PERFORATIONS

BACKGROUND OF THE INVENTION

The present invention relates to the field of lined explosive charges for perforating targets. More particularly, the present invention relates to a spoiler in a shaped charge for modifying a material perforating jet to produce a large target hole downhole in a well.

The invention is particularly useful in the field of downhole well casing perforation. Well casing is typically installed in boreholes drilled into subsurface geologic formations. The well casing prevents uncontrolled migration of subsurface fluids between different well zones and provides a conduit for production tubing in the well. The well casing also facilitates the running and installation of production tools in the well. Well tubing can be installed within well casing to convey fluids to the well surface.

To produce reservoir fluids such as hydrocarbons from a subsurface geologic formation, the well casing is perforated by multiple high velocity jets from perforating gun shaped charges. A firing head in the perforating gun detonates a primary explosive and ignites a booster charge connected to a primer or detonator cord. The detonator cord transmits a detonation wave to each shaped charge.

In a conventional shaped charge, booster charges within each shaped charge activate explosive material which collapse a shaped liner toward the center of a cavity formed by the shaped charge liner. The collapsing liner generates a centered high velocity jet for penetrating the well casing and the surrounding geologic formations. The jet properties depend on the charge shape, released energy, and the liner mass and composition. Shaped charge jets perforate the well casing and establish a flow path for the reservoir fluids from the subsurface geologic formation to the interior of the well casing. This flow path can also permit solid particles and chemicals to be pumped from the casing interior into the geologic formation during gravel packing operations.

Various efforts have been made to modify the performance of shaped charges. Barriers and voids have been placed within the explosive material to modify the detonation wave shape collapsing the liner. Examples of detonation wave shaping techniques are described in U.S. Pat. No. 4,594,947 to Aubry et al. (1986), U.S. Pat. No. 4,729,318 to Marsh (1988), and U.S. Pat. No. 5,322,020 to Bernard et al. (1994). In each of these patents, detonation wave shapers are positioned in the explosive material between the detonator cord and the liner.

As the liner collapses toward the shaped charge center, a conventional shaped charges generates relatively small perforations in a well casing. Because a high velocity jet is relatively long in configuration, the entry size of the resulting perforations is only slightly larger than the perforating jet diameter. If the jet velocity is slowed to create a more bulbous jet, the jet energy initially creates a relatively large target entry diameter which quickly narrows as the jet penetrates through the target. Such jets can result in a large entrance and a small exit aperture through the target. The process limits the shaped charge effectiveness when the shaped charges are retained by a gun carrier because the jet energy is substantially expended as the jet exits the gun carrier, thereby diminishing the jet energy available to penetrate the downhole well target.

A need exists for an apparatus that can create large diameter perforations in well casing and other selected targets. In certain well completion activities such as gravel packing operations, large diameter well perforations are desirable to facilitate the rapid placement of solid particles into the well. To accomplish this objection, a perforating gun should remove a large target surface area before the energy of the perforating jet is expended.

SUMMARY OF THE INVENTION

The present invention provides an apparatus actuatable by a detonator to perforate a material. The apparatus comprises a housing, a recess defined by an inner housing surface within the housing, an explosive material for creating a detonation wave, a shaped liner proximate to the explosive material and collapsable about a hollow space to form a material penetrating jet, and a spoiler within the liner hollow space for defocusing the material penetrating jet.

In different embodiments of the invention, the spoiler can be spherical, cylindrical, or tapered, and can be hollow or substantially solid. The spoiler can be constructed with a passive or active material to modify the shape and performance of the material penetrating jet. The active material can comprise an elastic or explosive material which reacts against a collapsing shaped charge liner to create a hollow space within the perforating jet.

DESCRIPTION OF THE PREFERRED EMBODIMENTS

Figure 1:
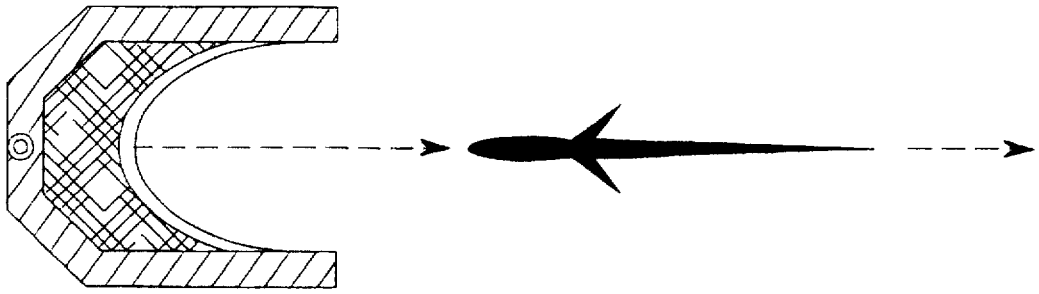
Fig. 1 Prior Art
FIG. 1 illustrates a sectional view of a conventional shaped charge and a material penetrating jet.

The present invention provides a unique apparatus for generating large perforations in a target material. As is known in the art, conventional shaped charges as shown in FIG. 1 ignite an explosive material to collapse a liner material about a cavity defined by the liner. The collapsing liner generates a high velocity jet traveling in a direction coincident with the liner cavity axis. The penetration hole diameter of a conventional high velocity jet depends on the diameter of the jet and the energy dissipated radially as such jet penetrates the target material. Consequently, the radial diameter penetratable by a conventional shaped charge jet is limited.

Figure 2:
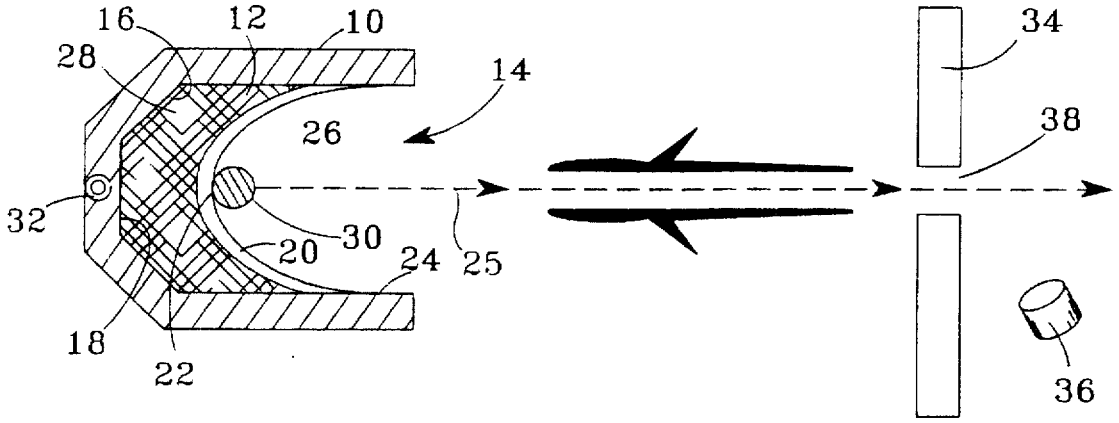
FIG. 2 illustrates a sectional view of a spherical spoiler positioned in contact with the apex of a liner and a material penetrating jet generated by such charge.

The present invention significantly improves conventional large hole penetration capability by creating a substantially larger hole in a target. Referring to FIG. 2, charge case or housing 10 defines a recessed cavity 12 having open end 14, housing wall 16, and closed end 18. If the cavity 12 of housing 10 has a parabolic or elliptical shape, wall 16 and closed end 18 are collectively defined by a continuous curved surface. Liner 20 forms a geometric figure having liner apex 22 and liner base 24 symmetrically formed about longitudinal axis 25. Liner 20 is positioned within cavity 12 so that liner apex 22 faces housing closed end 18. Liner base end 24 faces toward open end 14. Liner 20 defines a interior volume or hollow space 26 between base end 24 and liner apex 22. High explosive material 28 is positioned between housing wall 16 and liner 20, and spoiler 30 is positioned within hollow space 26.

Detonator 32 comprises a primer or detonator cord suitable for igniting high explosive material 28 to generate a detonation wave. Such detonation wave focuses liner 20 to collapse toward longitudinal axis 25 and to form a material perforating jet. As collapsing liner 20 moves towards open end 14, the jet also moves in such direction consistent with the law of momentum conservation. The jet exits housing 10 at high velocity and is directed toward the selected target. Although liner 20 is preferably metallic, liner 20 can be formed with any material suitable for forming a high velocity perforating jet.

Spoiler 30 is illustrated as a spherical member positioned within hollow space 26. As shown, spoiler 30 is preferably located proximate to liner apex 22 and symmetrical about longitudinal axis 25. Spoiler 30 defocuses the jet by interrupting or retarding the normal collapse of liner 20 and resisting the collapse of liner 20 along longitudinal axis 25. As the detonation wave focuses liner 20 to collapse inwardly, spoiler 30 retards such collapse so that liner 20 forms a toroidal or annular jet which exits open end 14.

The form of annular jet generated by liner 20 and spoiler 30 is represented in FIG. 2. The annular jet impacts and penetrates the material of target 34. Such jet penetration removes plug or cutout 36 from target 34 and forms window 38. By refocusing the jet penetrating energy on a circumferential ring instead of the center mass of cutout 36, shallower penetration into target 34 is achieved because the energy is diffused over a greater area and is not concentrated in the center. However, a larger total surface area of target 34 is removed than is possible with conventional shaped charge technology because the jet energy is not required to penetrate the center of target 34. Consequently, the invention can be used to perforate selected targets without disturbing other elements behind the initial target. This feature of the invention is useful downhole in a well because a well casing can be perforated without damaging frangible rock behind the well casing.

Figure 3:
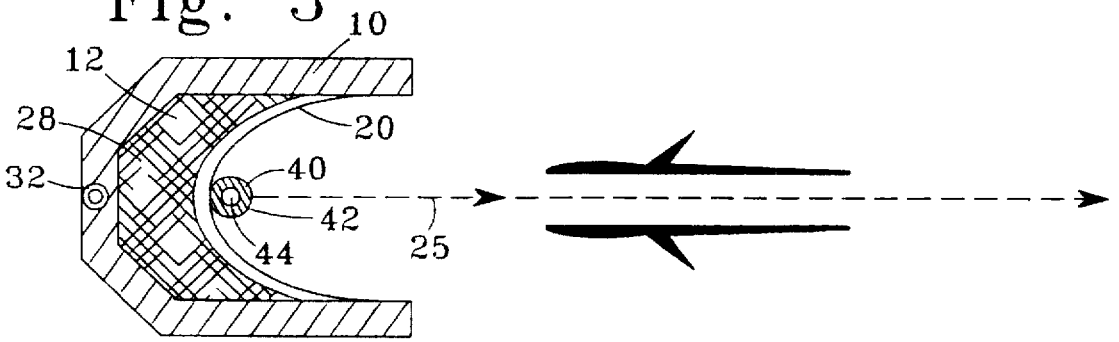
FIG. 3 illustrates a hollow spoiler.

FIG. 3 illustrates another embodiment of the invention wherein spoiler 40 is positioned in hollow space 26 within liner 20. Spoiler 40 is illustrated as a hollow sphere having exterior surface 42 and interior space 44. In this configuration, spoiler 40 performs differently than solid spoiler 30 when explosive material 28 collapses liner 20 inwardly toward longitudinal axis 25. Because spoiler 40 will flex more than spoiler 30, the resulting annular jet will have different characteristics than the jet formed by a shaped charge having a solid center.

Figure 4:
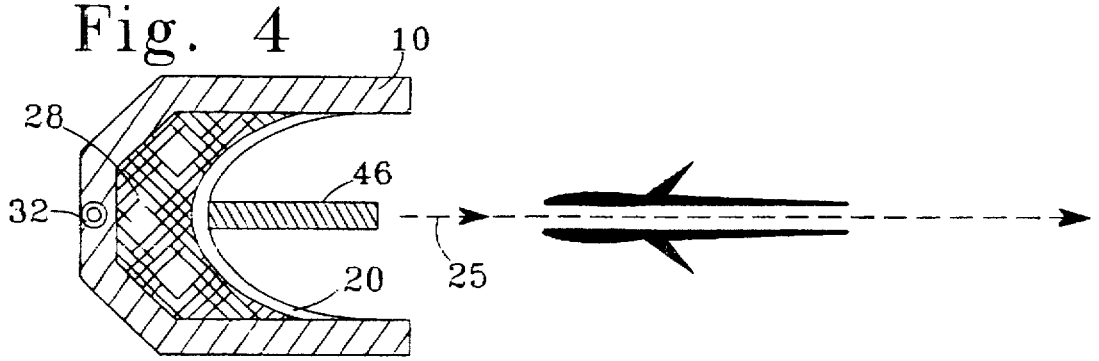
FIG. 4 illustrates a spoiler with a cylindrical exterior.

FIG. 4 illustrates another embodiment of the invention wherein spoiler 46 has an outer surface shaped as a cylinder symmetrically placed about longitudinal axis 25. Spoiler 46 provides the same function as spoilers 30 and 40 by defocusing the tendency of liner 20 to collapse toward longitudinal axis 25. By limiting such collapse, spoiler 46 causes liner 20 to be focused into a jet generally shaped as a toroid or annular ring.

Figure 5:
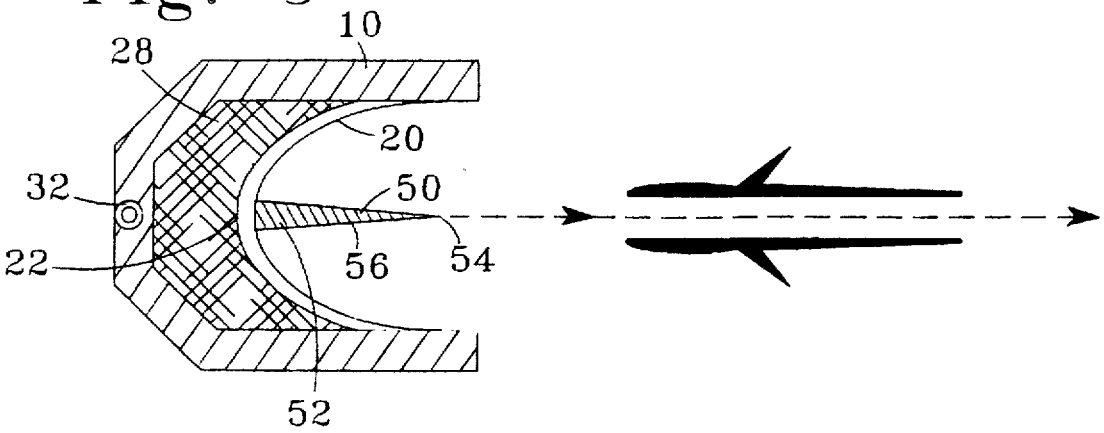
FIG. 5 illustrates a tapered spoiler.

FIG. 5 illustrates another embodiment of a spoiler for defocusing the collapse of liner 20. Spoiler 50 has first end 52 proximate to liner apex 22, and has second end 54 distal from liner apex 22. Spoiler 50 is symmetrically oriented about longitudinal axis 25. Exterior surface 56 tapers from first end 52 to second end 54. This taper affects the formation of the jet formed by the collapse of liner 20. Alternatively, the orientation of liner 50 could be reversed so that second end 54 is positioned proximate to liner apex 22. This orientation would provide a different response to the perforating jet formation as liner 20 collapses.

Spoilers 30, 40, 46 and 50 are illustrated as passive spoilers formed with a metallic, plastic, ceramic or other material. Such passive spoilers retard or resist the collapse of liner 20 toward longitudinal axis 25 so that a large diameter material penetrating jet is formed. A material or device which interrupts the conventional collapse of liner 20 is defined herein as a "passive spoiler". As illustrated in FIGS. 2 through 5, passive spoilers can be shaped as spheres, cylinders, tapered forms, or other configurations. The passive spoilers can be solid or can be constructed from different materials sufficient to form a hollow portion in the center of the material penetrating jets.

Figure 6:
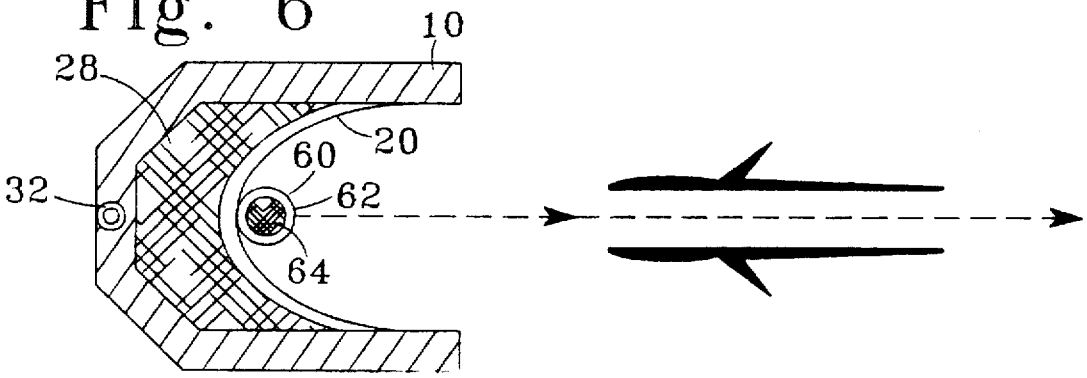
FIG. 6 illustrates an active material spoiler.

In other embodiments of the invention, an "active spoiler" can be positioned to cooperate with liner 20 as is shown in FIG. 6. In one inventive embodiment, active spoiler 60 is formed with shell 62 around an explosive material, a non-explosive elastic material, or other type of material shown at 64 which positively reacts against the collapse of liner 20 after explosive material 28 is initiated. If active spoiler 60 includes an explosive material 64 initiated during the collapse of liner 20, material 64 enlarges the diameter of the material penetrating jet formed during the collapse of liner 20. If material 64 is an elastic material such as a rubber or highly elastic synthetic material, material 64 will initially absorb energy from collapsing liner 20 and will subsequently release a substantial amount of such energy back into the material penetrating jet. Such release of energy from active spoiler 60 enlarges or otherwise modifies the cross-sectional diameter of the material penetrating jet. The configuration, length, width, initiation time, shape and composition of active spoiler 60 will affect the impact of active spoiler 60 on the material penetrating jet formed during the collapse of liner 20.

Figure 7:
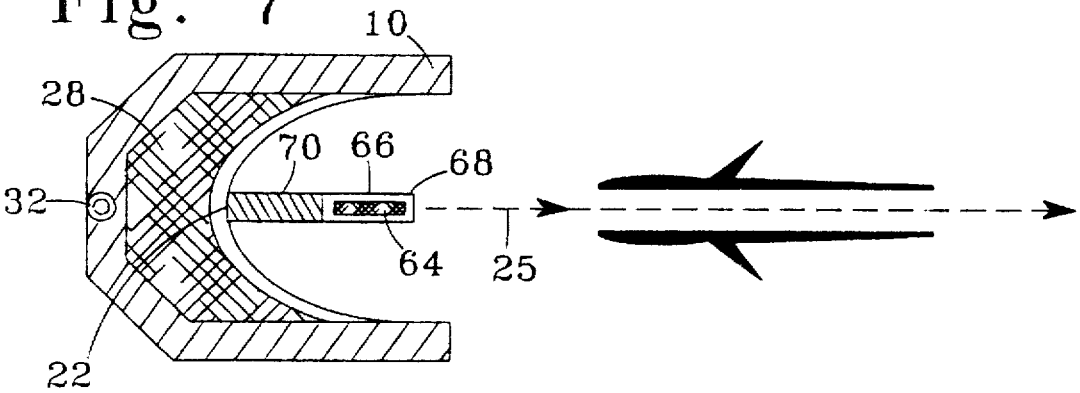
FIG. 7 illustrates a spacer for retaining an active material spoiler in a fixed orientation relative to the liner.

FIG. 7 illustrates one embodiment of an active spoiler 66 wherein material 64 comprises a high explosive material initially retained with housing 68. Spacer 70 is positioned between the liner apex 22 and housing 68 to lengthen the distance between high explosive material 64 and liner apex 22. In this embodiment of the invention, spacer 70 provides a technique for delaying the detonation of high explosive material 64. As liner 20 collapses toward longitudinal axis 25, collapsing liner 20 compresses high explosive material 64 and initiates material 64 when a critical compression value is reached. The initiation of material 64 generates expansive gases having a radial velocity which react against collapsing liner 20, thereby producing a cavity within the resulting material penetrating jet. The length, diameter and placement of spacer 70 will affect the collapse of liner 20 and the impact of high explosive material 64 in shaping the material penetrating jet.

The present invention modifies the conventional collapse of shaped charge liners by forming a material penetrating jet having a larger diameter than conventional jets. By defocusing the jet formation, the jet energy is substantially blocked from forming in the center and is refocused into a toroidal shape or annular ring having a larger diameter than conventional jets. The resulting jet creates a larger hole in the target than conventional jets formed in the absence of a spoiler. The jet hole size, penetration, and other factors can be controlled by the size, composition, orientation and other characteristics of the spoiler. For example, the size and performance of the spoiler can be selected to account for the internal stand-off between the shaped charge and a gun housing, the distance between a carrier gun and well casing, and the casing wall thickness.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus actuatable by a detonator to perforate a material, downhole in a wellbore comprising:

a housing;

a recess defined by an inner housing surface within said housing;

an explosive material within said recess which can be initiated by the detonator to create a detonation wave;

a shaped liner proximate to said explosive material, wherein said shaped liner defines a hollow space having a longitudinal axis within said recess and said shaped liner is collapsable about said hollow space when impacted by said detonation wave to form a material penetrating jet moving substantially parallel to said longitudinal axis; and a spherical spoiler within said hollow space for defocusing said material penetrating jet, wherein said spoiler is centered about said longitudinal axis.

2. An apparatus actuatable by a detonator to perforate a material, comprising:

a housing;

a recess defined by an inner housing surface within said housing;

an explosive material within said recess which can be initiated by the detonator to create a detonation wave;

a shaped liner proximate to said explosive material, wherein said shaped liner defines a hollow space having a longitudinal axis within said recess and said shaped liner is collapsable about said hollow space when impacted by said detonation wave to form a material penetrating jet moving substantially parallel to said longitudinal axis; and an active spoiler within said hollow space for positively reacting against said collapsing liner to modify the cross-sectional diameter of said material penetrating jet.

3. An apparatus as recited in claim 2, wherein said active spoiler includes a high explosive material.

4. An apparatus as recited in claim 2, further comprising a spacer for retaining said spoiler in a selected orientation relative to said liner.

5. An apparatus actuatable by a detonator downhole in a well to generate a large diameter perforation in a material, comprising:

a housing which can be positioned downhole in the well;

a recess defined by an inner housing surface within said housing and having an open end facing the material;

an explosive material within said recess which can be initiated by the detonator to create a detonation wave;

a shaped liner proximate to said explosive material, wherein said shaped liner defines a hollow space along a longitudinal axis within said recess, and wherein said shaped liner is collapsable about said hollow space when impacted by said detonation wave to form a material penetrating jet for exiting said recess open end and for perforating the material; and a spherical spoiler within said hollow space for defocusing said material penetrating jet before said jet contacts the material, wherein said spoiler is centered along said longitudinal axis.

6. An apparatus as recited in claim 1, wherein said spoiler is hollow.

7. An apparatus as recited in claim 5, wherein said spoiler is hollow.

8. An apparatus as recited in claim 2, wherein said active spoiler includes a non-explosive elastic material.

9. An apparatus as recited in claim 2, wherein said active spoiler is formed with a metallic outer surface filled with a material for positively reacting against said collapsing liner.

10. An apparatus as recited in claim 2, wherein an exterior surface of said active spoiler contacts said shaped liner.

11. An apparatus as recited in claim 4, wherein said spacer contacts said shaped liner and said active spoiler.

12. An apparatus as recited in claim 11, wherein said spacer retaines said active spoiler at a selected distance from said shaped liner until said shaped liner is collapsed to form said material penetrating jet.

* * * * *